US005395085A

United States Patent [19]

Mann

[11] Patent Number: 5,395,085

[45] Date of Patent: Mar. 7, 1995

[54] THEATER DRINK/CUP HOLDER

[76] Inventor: Glenn E. Mann, 122 Sherlake Rd., Knoxville, Tenn. 37922

[21] Appl. No.: 217,373

[22] Filed: Mar. 24, 1994

[51] Int. Cl.[6] ..... A47K 1/08

[52] U.S. Cl. ..... 248/311.2; 224/275; 297/188.14

[58] Field of Search ..... 248/311.2, 313; 297/194; 108/26; 224/275, 42.45 R, 42.44; 211/71

[56] References Cited

U.S. PATENT DOCUMENTS

| | | | |
|---|---|---|---|
| 3,186,673 | 6/1965 | Olson | 297/194 X |
| 3,784,142 | 1/1974 | O'Brien | 108/26 X |
| 4,262,962 | 4/1981 | Yust | 297/194 |
| 4,548,326 | 10/1985 | Danna | 211/71 |
| 4,560,128 | 12/1985 | Willeby et al. | 248/230 |
| 4,728,147 | 3/1988 | Dutton | 297/194 |
| 4,795,211 | 1/1989 | Stern et al. | 297/194 |
| 4,798,413 | 1/1989 | Capelli | 297/194 |
| 4,863,134 | 9/1989 | Young et al. | 248/311.2 |
| 4,984,722 | 1/1991 | Moore | 224/42.43 |
| 5,014,956 | 5/1991 | Kayali | 248/311.2 |
| 5,042,770 | 8/1991 | Louthan | 248/311.2 |
| 5,060,899 | 10/1991 | Lorence | 248/311.2 |
| 5,106,046 | 4/1992 | Rowles et al. | 248/311.2 |
| 5,118,063 | 6/1992 | Young, Sr. | 248/311.2 |
| 5,139,222 | 8/1992 | Koorey et al. | 248/311.2 |
| 5,238,212 | 8/1993 | Dechellis | 248/311.2 |
| 5,284,314 | 2/1994 | Misaras | 224/42.44 |
| 5,316,368 | 5/1994 | Arbisi | 224/275 X |
| 5,330,146 | 7/1994 | Spykerman | 224/42.45 R |

*Primary Examiner*—J. Franklin Foss
*Attorney, Agent, or Firm*—Pitts & Brittian

[57] ABSTRACT

A theater drink/cup holder (10) which allows the user to have a cup holding device at the end of a theater chair's armrest (54) in theaters which do not already provide such a device for patrons. The theater drink/-cup holder (10) comprises at least one cup holding piece (12), at least two angle-shaped securing arms (14), and at least one securing strap (16). The securing arms (14) are secured to the cup holding piece (12) such that the securing arms (14) are parallel to each other. The securing arms (14) are placed in communication with the sides of the armrest (54). The securing strap (16) is then secured from one securing arm (14) to the other over the top of the armrest (54).

19 Claims, 3 Drawing Sheets

THEATER DRINK/CUP HOLDER

TECHNICAL FIELD

This invention relates to the field of cup and beverage container holders. More specifically the theater drink/-cup holder of the present invention provides a device which removably attaches to the armrest of a theater chair, holds a cup proximate the end of the armrest, and is portable by the user. In this way, the user has a device which holds a cup at the end of an armrest in theaters in which such cup holders are not already provided for the patrons.

BACKGROUND ART

Almost since the inception of theater-going and movie-going as popular entertainment, theater owners and operators have sought both to please patrons and to increase revenue by selling various refreshments and snacks in addition to tickets. This includes drinks of various types.

The problems attendant with drinks in theaters are many. Chief among these is where to put the drink when the patron is not drinking. If placed on the floor, the drink is easily kicked over or knocked over when the patron reaches for the drink. If placed between the patron's legs, the drink could still spill causing even worse problems than spilling the drink on the floor. However, even if the drink is placed between the patron's legs and does not spill, the drink still causes condensation to saturate the patron's legs or pants legs. This surely makes the patron uncomfortable.

To solve this problem, many theaters have employed cup holders secured, formed, or joined in a permanent fashion to the end of theater chair armrests. Two examples of such inventions are U.S. Pat. No. 4,863,134, issued to John R. Young and Larry L. Jacobson on Sep. 5, 1989, and U.S. Pat. No. 4,795,211, issued to Jon L. Stern, Richard S. Katz, and Keith A. Hippley, issued on Jan. 3, 1989. These inventions are designed to accept the standard sized cups in which theaters sell their drinks. However, these inventions are not portable. They are meant to stay in the theater attached to the armrest. This is fine in the theaters which have such holders. But many theaters have yet to employ such devices. This leaves many theater patron's with the same "on the floor" or "between the legs" options.

Thus, it is an object of the present invention to provide a theater drink/cup holder which,is removably attachable to theater chair armrests.

Another object of the theater drink/cup holder is that the invention is inexpensive and easily deployable.

DISCLOSURE OF THE INVENTION

Other objects and advantages will be accomplished by the present invention which serves to allow a cup holding piece to be used with an armrest of a theater chair so as to hold the cup while the patron is not drinking from the cup. In accordance with the various features of the invention, a theater drink/cup holder is provided. The theater drink/cup holder comprises at least one cup holding piece, at least two securing arms, and at least one securing strap. The securing arms are secured to the cup holding piece such that the securing arms are parallel to each other and spaced a distance apart so as to receive an armrest between them. The securing arms are placed in communication with the sides of the armrest. The securing strap is then secured from one securing arm to the other over the top of the armrest. In this way, the theater drink/cup holder allows the user to have a cup holder at the end of an armrest on which there is otherwise no cup holding device.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A theater drink/cup holder incorporating various features of the present invention is illustrated generally at 10 in the figures. The theater drink cup holder 10 is designed to be removably attached to a theater chair armrest 54 and to accept the standard sized cups in which theaters serve their drinks. In this way, the theater drink/cup holder 10 allows the theater patron to have a device which holds a cup proximate the end of an armrest 54 in theaters which do not provide such devices for the patrons. Moreover, the theater drink/-cup holder 10 is inexpensive and easily deployed.

Figure 1:
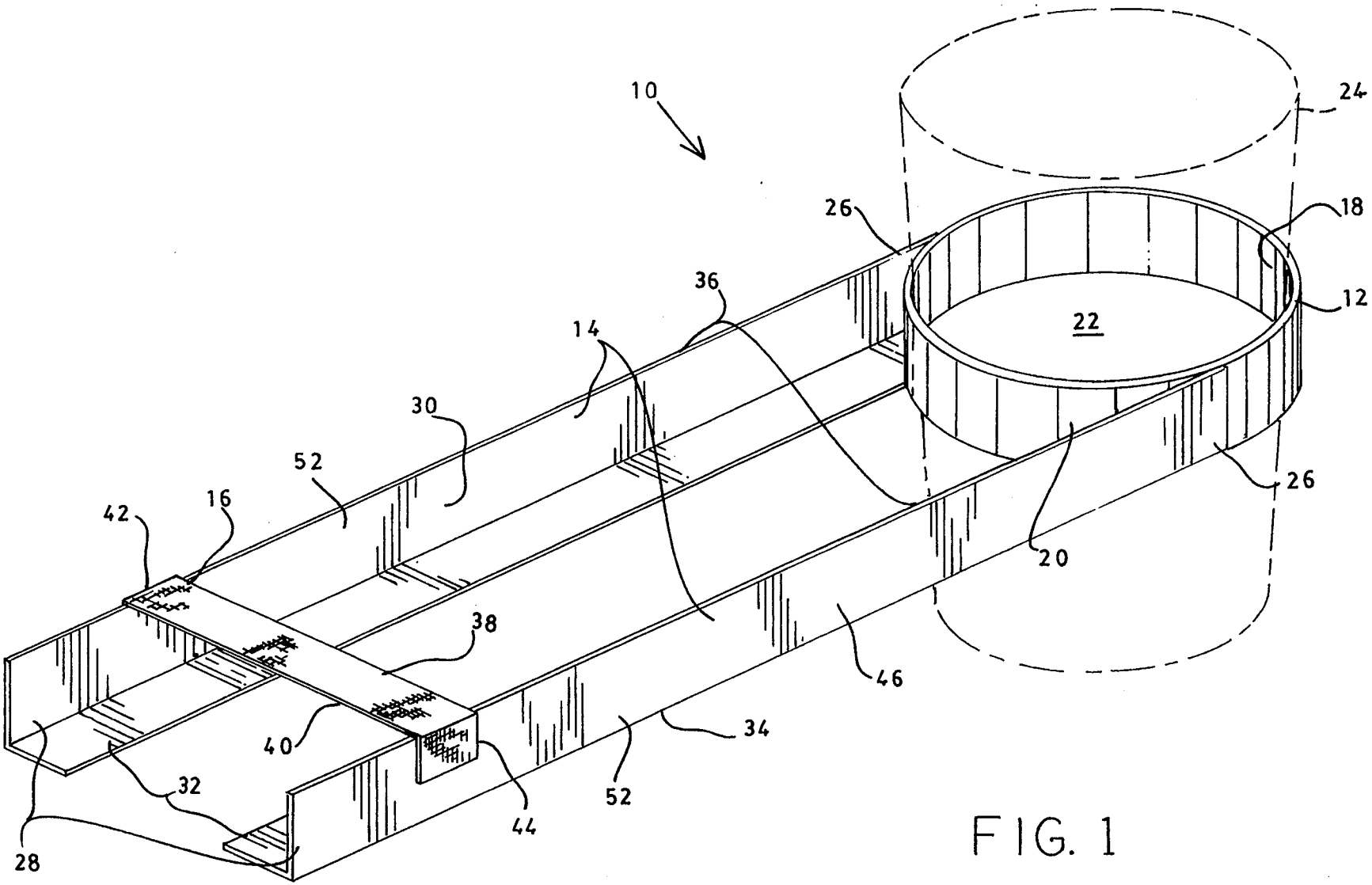
FIG. 1 is a perspective view of the theater drink/cup holder.
Figure 2:
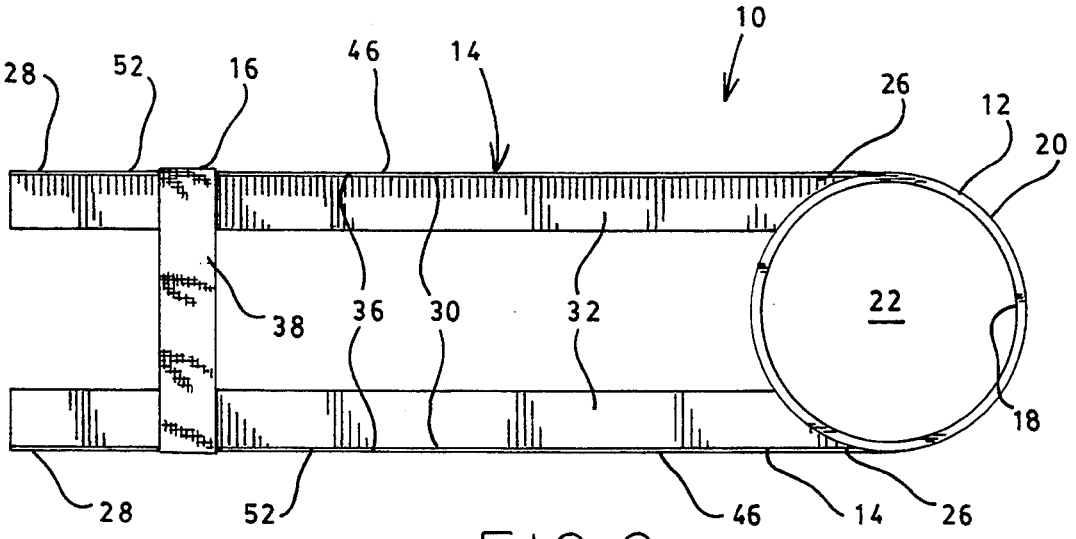
FIG. 2 is a top plan view of the theater drink/cup holder of FIG. 1.
Figure 3:
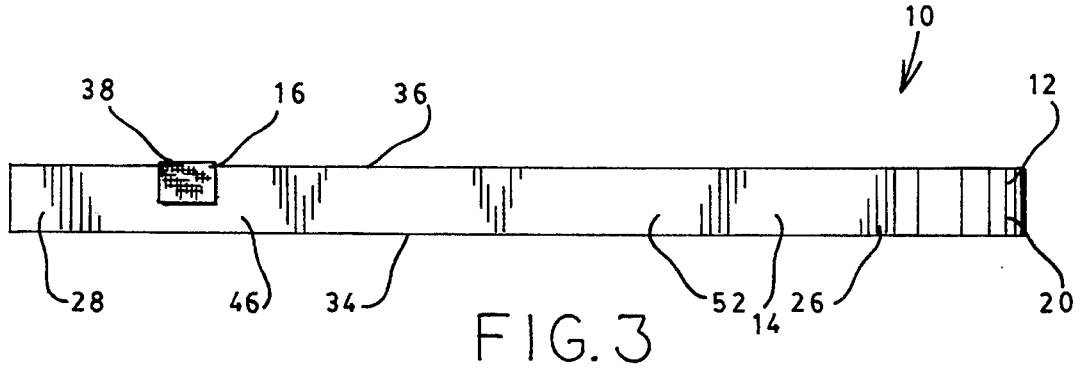
FIG. 3 is a side elevational view of the theater drink/-cup holder of FIG. 1.

The theater drink/cup holder 10 comprises at least one cup holding piece 12, at least two securing arms 14, and at least one securing strap 16. In the preferred embodiment, there is one cup holding piece 12, as shown in FIGS. 1 and 2. The cup holding piece 12 defines a substantially cylindrical configuration. The cup holding piece 12 comprises an inner face 18, an outer face 20, and an opening 22 defined thereby. The opening 22 is dimensioned such that the cup holding piece 12 closely receives and holds standard-sized cups in which theaters serve drinks. The cup 24 is restrained from falling through the opening 22 because the angled outside surface of the cup 24 engages the inner face 18 of the cup holding piece 12.

In an alternate embodiment, more than one cup holding piece 12 may be employed. A different embodiment may include a substantially vertical inner face 18. In yet another embodiment, the inner face 18 may be angled away from the vertical. This serves to provide more stable support as the cup 24 usually has angled sides.

In the preferred embodiment, two securing arms 14 are used, as shown in FIGS. 1 and 2. The securing arms 14 are angle-shaped members. Each securing arm 14 comprises a vertical member 52 and a supporting piece 32. Each vertical member 52 is a substantially vertical elongated rectangular piece, defining a first end 26, a second end 28, a top edge 36, a bottom edge 34, an inner surface 30, and an outer surface 46. The longer axis of the vertical member 52 of the securing arm 14 is substantially parallel to the ground while the shorter axis is substantially perpendicular to the ground. Each vertical member 52 of the securing arms 14 is substantially parallel to each other. The inner surface 30 of each vertical member 52 is secured, proximate the first ends 26, to the outer face 20 of the cup holding piece 12 with the second ends 28 extending away from the cup holding piece 12 in a selected direction. In the preferred embodiment, the first ends 26 are integrally formed with the outer face 20 of the cup holding piece 12. In an alternate embodiment, the first ends 26 of the securing arms 14 may be removably secured to the outer face 20 of the cup holding piece 12. In yet another embodiment, more than two securing arms 14 may be employed.

The securing arms 14 include supporting pieces 32. The supporting pieces 32 are substantially horizontal, elongated rectangles secured proximate the bottom edges 34 of the each vertical member 52. Both the longer axis and the shorter axis of the supporting pieces 32 are substantially parallel to the ground. The length of the supporting piece 32 is substantially the same as the length of the associated vertical member 52. In an alternate embodiment, the supporting pieces 32 could be any length practicable. In yet another embodiment, the supporting pieces could be a series of smaller pieces secured proximate the bottom edge 34 at intervals.

Figure 5:
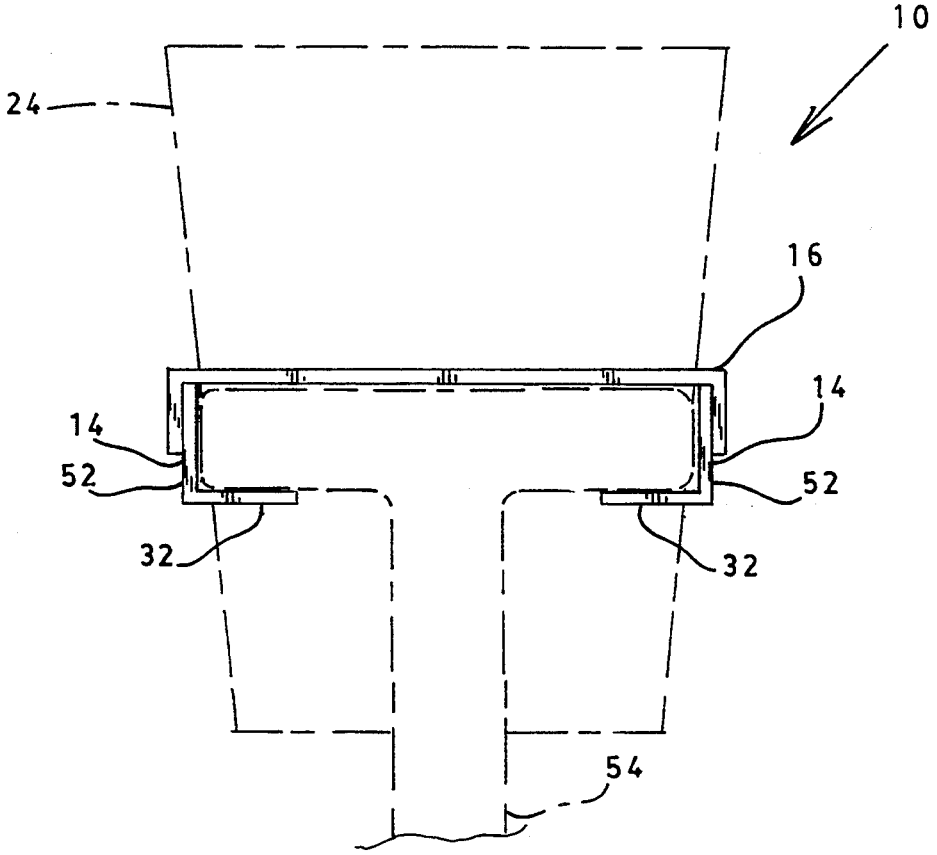
FIG. 5 is a front elevational view of the theater drink/cup holder of FIG. 1 being used in conjunction with a theater armrest.

The securing arms 14 of the preferred embodiment are made from a material which defines substantially flexible properties, such as plastic. The securing arms 14 are separated by a selected distance so as to allow the securing arms 14 to receive an armrest 54 between them as shown in FIG. 5. This allows the securing arms 14 to be flexed away from each other. This, in turn, allows the theater drink/cup holder 10 to be adapted for use with armrests 54 of various widths.

The securing strap 16 is a strip of preferably cloth-like material. In an alternate embodiment, the securing strap 16 may be of any material. The securing strap 16 defines a first end 42, a second end 44, a top surface 38, and a bottom surface 40. The securing strap 16 proximate first end 42 is secured to one securing arm 14 while the securing strap be proximate the second end 44 is secured to the other securing arm 14.

Figure 4:
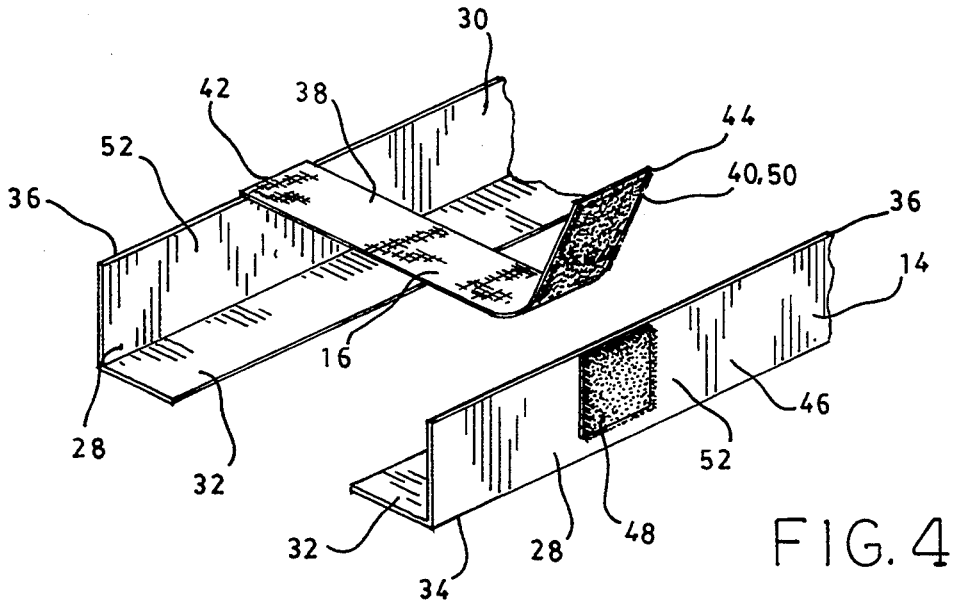
FIG. 4 is a partial perspective view of the second end of two securing arms including a the securing strap employing, as a securement device, a hook and loop fastener.

At least the second end 44 of the securing strap 16 is removably secured to one securing arm 14. In the preferred embodiment, the theater/drink cup holder 10 employs a securement device for removably securing the second end 44 of the securing strap 16 to one securing arm 14. The preferred securement device is a hook 48 and loop 50 fastener, as shown in FIG. 4. In this embodiment, the loops 50 are secured to the bottom surface 40 of the securing strap 16 while the hooks 48 are secured to the outer surface 46 of the securing arm 14. In this embodiment, the first end 42 of the securing strap 16 may be permanently secured or removably secured in any fashion to the other securing arm 14.

In an alternate embodiment, the hooks 48 are secured to the bottom surface 40 of the securing strap 16 while the loops 50 are secured to the securing arm 14.

While one embodiment fo the employment of the securing strap 16 is shown in the figures, it will be understood from the language of the claims that the securing strap 16 may be secured to the securing arm 14 in any fashion.

To use the theater drink/cup holder 10, the user bends the securing arms 14 away from each other and places the theater drink/cup holder in communication with an armrest 54 of a theater chair such that the supporting pieces 32 engage the bottom of the armrest 54 and the inner surface 30 of the vertical member 52 of the securing arms 14 engages the sides of the armrest 54. In this way, the inner surface 30 of the vertical member 52 of the securing arms 14 substantially restrains the theater drink/cup holder 10 from side-to-side movement while the supporting pieces 32 substantially restrain the theater drink/cup holder 10 from moving in an upward direction from the armrest 54.

The second end 44 of the securing strap 16, which is removably securable, is then secured to the securing arm 14 such that the bottom surface 40 of the securing strap 16 engages the top of the armrest 54. In this way the theater drink/cup holder 10 is substantially restrained from movement in a downward direction.

While the preferred embodiment has been described and shown, it will be understood that these are not intended to limit the disclosure, but rather are intended to cover all modifications and alternate methods falling within the spirit and the scope of the invention as defined in the appended claims.

Having thus described the aforementioned invention, I claim:

1. A theater drink/cup holder for holding a cup proximate the end of a theater chair armrest, said theater drink/cup holder comprising:

at least one cup holding piece, each said cup holding piece defining a substantially cylindrical configuration having an inner face, an outer face, and an opening for receiving a drink cup;

at least two substantially parallel securing arms for engagement with the sides of an armrest, each said securing arm being an angle-shaped member, each said securing arm comprising a vertical member and a supporting piece, each said vertical member defining a first end attached to said cup holding piece, a second end, a top edge, a bottom edge, an outer surface, and an inner surface, each said supporting piece defining a substantially rectangular configuration, each said supporting piece being secured proximate said bottom edge of said associated vertical member for contact with an under surface of the armrest; and at least one securing strap, each said securing strap having a first end secured to one of said securing arms, a second end for releasible attachment to a second of said securing arms, a top surface, and a bottom surface.

2. The theater drink/cup holder of claim 1 wherein one said cup holding piece is utilized.

3. The theater drink/cup holder of claim 1 wherein each said opening of each said cup holding piece is dimensioned so as to closely receive a standard sized theater drink cup.

4. The theater drink/cup holder of claim 1 wherein there are two of said securing arms.

5. The theater drink/cup holder of claim 4 wherein each said inner surface proximate each said first end of each said vertical member of each said securing arm is secured to each said cup holding piece proximate said associated outer face.

6. The theater drink/cup holder of claim 5 wherein each said securing arm is substantially parallel to each other said securing arm, each said securing arm extending away from each said cup holding piece in the same direction, and said securing arms are spaced a distance apart so as to receive the armrest between said securing arms.

7. The theater drink/cup holder of claim 4 wherein each said inner surface proximate each said first end of each said vertical member of each said securing arm is integrally formed with each said cup holding piece proximate said associated outer face.

8. The theater drink/cup holder of claim 7 wherein each said securing arm is substantially parallel to each other said securing arm, each said securing arm extends away from each said cup holding piece in the same direction, and said securing arms are spaced a distance apart so as to receive the armrest between said securing arms.

9. The theater drink/cup holder of claim 1 wherein one of said securing straps is utilized.

10. The theater drink/cup holder of claim 1 wherein each said securing strap is selectively secured to at least one said securing arm proximate each said first end of each said securing strap, each said securing strap is selectively secured to at least one other said securing arm proximate each said second end of each said securing strap.

11. The theater drink/cup holder of claim 10 further comprising at least one securement device for removably securing at least one end of each said securing strap to one said securing arm.

12. The theater drink/cup holder of claim 11 wherein each said securement device is a hook and loop fastener.

13. A theater drink/cup holder for holding a cup proximate the end of a theater chair armrest, said theater drink/cup holder comprising:

at least one cup holding piece, each said cup holding piece defining a substantially cylindrical configuration having an inner face, an outer face, and an opening for receiving a drink cup, said opening dimensioned so as to closely receive the cup;

two substantially parallel securing arms for engagement with the sides of an armrest, each said securing arm being angle shaped, each said securing arm further comprising a vertical member and a supporting piece, each said vertical member defining a first end attached to said cup holding piece, a second end, a top edge, a bottom edge, an outer surface, and an inner surface, each said inner surface proximate each said first end of each said vertical member being secured to each said cup holding piece proximate said associated outer face, each said supporting piece defining a substantially rectangular configuration, each said supporting piece being secured proximate said bottom edge of said associated vertical member for contact with an under surface of the armrest, each said securing arm being substantially parallel to each other said securing arm, said securing arms being spaced a distance apart so as to receive the armrest between said securing arms, each said securing arm extending away from each said cup holding piece in the same direction; and at least one securing strap, each said securing strap having a first end selectively secured to one of said securing arms, a second end selectively secured to a second of said securing arms, a top surface, and a bottom surface.

14. The theater drink/cup holder of claim 13 further comprising at least one securement device attached to said second end of each said securing strap for removably securing said securing strap to said associated securing arm.

15. The theater drink/cup holder of claim 14 wherein each said securement device is a hook and loop fastener.

16. The theater drink/cup holder of claim 13 wherein one said cup holding piece is utilized.

17. The theater drink/cup holder of claim 13 wherein said securing arms are integrally formed with each said cup holding piece.

18. A theater drink/cup holder for holding a cup proximate the end of a theater chair armrest, said theater drink/cup holder comprising:

at least one cup holding piece, each said cup holding piece defining a substantially cylindrical configuration having an inner face, an outer face, and an opening for receiving a drink cup, said opening dimensioned so as to closely receive the cup;

two substantially parallel securing arms for engagement with the side of an armrest, each said securing arm comprising a vertical member and a supporting piece, each vertical member defining a first end attached to said cup holding piece, a second end, a top edge, a bottom edge, an outer surface, and an inner surface, each said supporting piece defining a substantially rectangular configuration, each said supporting piece being secured proximate said bottom edge of said associated vertical member, each said securing arm proximate each said first end of said vertical member being integrally formed with each said cup holding piece proximate said associated outer face, each said securing arm being substantially parallel to said other securing arm, said securing arms being spaced a distance apart such that the armrest may be received between said securing arms, and each said securing arm extending away from each said cup holding piece in the same direction;

at least one securing strap, each said securing strap having a first end selectively secured to one of said securing arms, a second end selectively secured to a second of said securing arms, a top surface, and a bottom surface; and at least one securement device attached to each said securing strap for removably securing at least one end of each said securing strap to said associated securing arm.

19. The theater drink/cup holder of claim 18 wherein said securement device is a hook and loop fastener.

* * * * *